United States Patent [19]

Goossens et al.

[11] Patent Number: 4,567,327

[45] Date of Patent: Jan. 28, 1986

[54] FLAT-DIAPHRAGM TRANSDUCER AND METHOD OF MANUFACTURING SUCH A TRANSDUCER

[75] Inventors: Urbanus P. M. Goossens; Gustaaf E. M. Fierens, both of Dendermonde, Belgium

[73] Assignee: U.S. Philips Corporation, New York, N.Y.

[21] Appl. No.: 462,274

[22] Filed: Jan. 31, 1983

[30] Foreign Application Priority Data

Feb. 4, 1982 [NL] Netherlands ..... 8200416

[51] Int. Cl.[4] ..... H04R 7/12

[52] U.S. Cl. ..... 179/115.5 R; 181/173

[58] Field of Search ..... 179/181 R, 116, 115.5 ES, 179/115.5 R, 181 W; 181/144, 163, 150, 173

[56] References Cited

U.S. PATENT DOCUMENTS 4,198,550 4/1980 Matsuda ..... 179/181 R

FOREIGN PATENT DOCUMENTS

| | | | |
|---|---|---|---|
| 479547 | 12/1951 | Canada | 181/150 |
| 54-63023 | 12/1979 | Japan | 179/181 R |
| 55-41066 | 3/1980 | Japan | 179/181 R |
| 56-15799 | 4/1981 | Japan | 179/181 R |
| 57-72496 | 6/1982 | Japan | 179/181 R |
| 322579 | 12/1929 | United Kingdom | 179/115 |
| 2079564 | 8/1981 | United Kingdom | 179/115 |
| 0068285 | 6/1982 | United Kingdom | 179/115 |

*Primary Examiner*—Thomas W. Brown

*Attorney, Agent, or Firm*—Robert T. Mayer; Bernard Franzblau

[57] ABSTRACT

An electrodynamic transducer of the flat-diaphragm type in which the movement of the voice coil and coil former (2, 3) is transmitted to the flat diaphragm (1) via at least one auxiliary cone (8 or 20). The auxiliary cone is secured to a centering diaphragm (7) along its outer rim (10), if required via a coupling element (23). This is advantageous in the construction and the method of manufacturing the transducer. Moreover, a low-distortion transducer is obtained. A method of manufacturing the transducer is disclosed.

17 Claims, 4 Drawing Figures

FLAT-DIAPHRAGM TRANSDUCER AND METHOD OF MANUFACTURING SUCH A TRANSDUCER

This invention relates to an electrodynamic transducer which comprises a sound-radiating diaphragm having a substantially flat sound-radiating side, a magnet system, a voice coil which co-operates with the magnet system and which is arranged on a voice-coil former in an air gap of the magnet system, an auxiliary cone for transmitting the movement of the voice-coil former to the sound-radiating diaphragm, which auxiliary cone comprises an inner rim and an outer rim and is secured at its inner rim to the voice-coil former and at its outer rim to the sound-radiating diaphragm, and at least one centering diaphragm. The invention also relates to a method of manufacturing an electrodynamic transducer in accordance with the invention. An electrodynamic transducer of the type mentioned in the preamble is known from Japanese Kokai No. 32900/81. A centering diaphragm, as used in the transducer in accordance with the invention, is to be understood to mean: the diaphragm which centres the sound-radiating diaphragm relative to the loudspeaker chassis. In the known transducer this centering diaphragm is secured to the sound-radiating diaphragm and to the loudspeaker chassis.

The known transducer may be constructed by either of two methods. The first method is as follows:

(a) as a first step a plurality of assemblies are manufactured, namely
  an assembly comprising the voice-coil former, voice-coil and auxiliary cone, and
  an assembly comprising the sound-radiating diaphragm and the centering diaphragm.

For this purpose the centering diaphragm is secured to the sound-radiating diaphragm along the circumference thereof, (b) as a second step mounting assembly comprising the voice-coil and auxiliary cone by centering means known per se (for example by centering on the core of the magnet system or by means of a centering sleeve around the core). Thus, the voice-coil former and the voice coil are centred in the air gap. This centering is maintained in that a centering diaphragm in the form of a spider arranged on the voice-coil former is secured to the loudspeaker chassis, (c) as a third step mounting the assembly comprising the sound-radiating diaphragm and the centering diaphragm. The sound-radiating diaphragm is secured to the outer rim of the auxiliary cone and the centering diaphragm is secured to the loudspeaker chassis.

As the outer rim of the auxiliary cone is not yet secured prior to the third step because this auxiliary cone is only retained at its inner rim via the voice-coil former and the spider, the connection of the auxiliary cone and the sound-radiating diaphragm to each other will not be satisfactory along the entire outer rim of the auxiliary cone and, in general, the connection to the sound-radiating diaphragm will not be at the correct position in the third step. As a result of this unsatisfactory connection of the sound-radiating diaphragm to the auxiliary cone and the incorrect position of the connection between the sound-radiating diaphragm and the auxiliary cone, the radiated sound will be distorted substantially upon excitation of the diaphragm (for example, as a result of misalignment of the voice coil and/or the voice-coil former in the air gap).

The second method of constructing the known transducer is as follows:

(a) as a first step an assembly comprising the voice-coil former, voice coil, spider (if present), auxiliary cone, sound-radiating diaphragm and centering diaphragm is manufactured, (b) as a second step the assembly will then be positioned in the magnet system and secured to the loudspeaker chassis by means of the centering diaphragm and (if present) the spider, which is secured to the voice-coil former. This presents the problem that positioning relative to the core of the magnet system is no longer possible unless a hole is made in the flat diaphragm, which hole is to be closed again after the complete system has been mounted. If this last-mentioned possibility is rejected, intricate manufacturing and centring processes are necessary, or an unsatisfactory centring must be accepted, which again means a higher distortion of the radiated sound.

It is an object of the invention to provide a transducer which can be manufactured in a simpler manner and whose radiated acoustic waves exhibit a substantially lower distortion. To this end the transducer in accordance with the invention is characterized in that the auxiliary cone is connected at its outer rim to the centring diaphragm, if desired via a coupling element (coupling elements).

The invention is based on the perception that the distortion of the radiated sound is mainly caused by a poor centring of the sound-radiating diaphragm, auxiliary cone and voice-coil former with voice coil relative to the magnet system and the loudspeaker chassis, which poor centring is caused by the inconvenient construction of the known transducer.

By securing the centring diaphragm in the transducer in accordance with the invention to the outer rim of the auxiliary cone, as the case may be via one or more coupling elements, instead of to the sound-radiating diaphragm, it is then possible to mount and centre the assembly of voice-coil former with voice coil, auxiliary cone, coupling element (if present) and centring diaphragm on the core of the magnet system in a manner which is customary for cone loudspeakers (see the aforesaid first method, point b) and subsequently to mount the sound-radiating diaphragm.

A first embodiment of the transducer in accordance with the invention is characterized in that the outer rim of the auxiliary cone is secured to the sound-radiating diaphragm along the circumference of said diaphragm and is also secured directly to the centring diaphragm, and the transducer further comprises a further auxiliary cone, whose inner rim is also secured to the voice-coil former and whose outer rim is secured to the sound-radiating diaphragm, the further auxiliary cone being disposed inside said first-mentioned auxiliary cone. In the embodiment in which only one auxiliary cone is secured directly, that is without the use of a coupling element, to the centring diaphragm and also to the sound-radiating diaphragm along the circumference of this diaphragm, the problem arises that the diaphragm may vibrate at its lowest and also at higher natural resonant frequencies. This gives rise to peaks in the frequency-response curve of the transducer, thereby reducing the operating frequency range of the transducer. In order to preclude this, an additional auxiliary cone is arranged inside the said auxiliary cone. The additional auxiliary cone, because its inner rim is also secured to the voice-coil former and its outer rim is also secured to the sound-radiating diaphragm, prevents the diaphragm from vibrating at a natural resonant frequency (especially the lowest natural resonant frequency). The frequency response of the transducer then remains flat over a wider frequency range. Moreover, as it is now driven via more auxiliary cones, the diaphragm itself may be less stiff for example by reducing the thickness of the diaphragm, which means that the weight of the diaphragm may also be reduced. This is of advantage in the electro-acoustic conversion whose efficiency is increased thereby. The transducer has a higher efficiency. It is to be noted that from the said Japanese Kokai No. 32900/81 a transducer is known which also comprises a further auxiliary cone which is arranged within the first-mentioned auxiliary cone. However, in the known transducer the first-mentioned auxiliary cone is not secured to the sound-radiating diaphragm along the circumference of said diaphragm. Moreover, the centring diaphragm is secured to the (front of) the sound-radiating diaphragm only—i.e. not to the auxiliary cone.

A second embodiment of the transducer in accordance with the invention is characterized in that the outer rim of the auxiliary cone and the sound-radiating diaphragm are secured to each other along a line situated within the circumference of the sound-radiating diaphragm, and the auxiliary cone is secured to the centring diaphragm via the coupling element (or coupling elements). The coupling element(s) is (are) secured to the sound-radiating diaphragm at least at the location of the portion where it is (they are) secured to the centring diaphragm. The connection between the auxiliary cone and the centring diaphragm can thus be obtained by the use of one or more coupling elements. Suitably, a coupling element will be used which consists of one piece. The auxiliary cone and the coupling element (or coupling elements) may be made of the same material and may be integral with one another. Alternatively, the coupling element (or coupling elements) and the centring diaphragm are of the same material and are integral with one another. Preferably, the nodal drive is used in the second embodiment. The afore-mentioned line is then generally the nodal line for the first (i.e. lowest) natural resonant frequency of the sound-radiating diaphragm. The nodal line designates those points on the diaphragm surface where the diaphragm vibrates at its first natural resonant frequency and has zero-excursion. By driving the diaphragm along this line or only at a number of points disposed on this line vibration of the diaphragm in said natural resonant frequency is precluded. Then, this natural resonant frequency is not excited. The frequency response of the transducer consequently remains flat over a wider frequency range. Said second embodiment can also be manufactured very simply. In both embodiments an auxiliary cone and/or the coupling element (if present) may be formed with perforations. This minimizes the weight of the moving part of the transducer, which results in a higher transducer efficiency.

It is to be noted that in commonly used cone loudspeakers, as inter alia known from "Acoustics" by L. L. Beranek, page 184, FIG. 7.1, the outer rim of the cone is secured directly to the centring diaphragm. However, arranging a flat sound-radiating diaphragm on and securing such a flat diaphragm to the outer rim of the cone of such a loudspeaker does not result in the first embodiment of the transducer in accordance with the invention. Indeed, this embodiment comprises a second auxiliary cone for exciting the flat diaphragm and for suppressing natural resonance of the flat diaphragm (especially the lowest natural resonant frequency) which would occur in the absence of the second auxiliary cone and which would seriously disturb the frequency behaviour of the transducer. Providing the known cone loudspeaker with a flat diaphragm (in the manner described in the foregoing) also will not produce the second embodiment of a transducer in accordance with the invention. The nodal drive would not be possible because the portion of the flat diaphragm which projects from the outer rim of the cone impedes the movement of the centring diaphragm so that undistorted electro-acoustic conversion is not possible. In this embodiment the arrangement of a coupling element between the centring diaphragm and the cone is therefore essential.

The method of manufacturing an electrodynamic transducer in accordance with the invention in the first embodiment described is characterized in that (a) as a first step a number of assemblies are manufactured namely
  an assembly comprising a loudspeaker chassis and the magnet system,
  an assembly comprising the voice-coil former, voice coil, auxiliary cone and centring diaphragm, and
  an assambly comprising the further auxiliary cone and the sound-radiating diaphragm,
(b) as a second step the assembly comprising the voice-coil former, voice coil, auxiliary cone and centring diaphragm is secured to the assembly comprising the loudspeaker chassis and the magnet system by centring means known per se, and
(c) as a third step the assembly comprising the further auxiliary cone and sound-radiating diaphragm is mounted.

The method of manufacturing an electrodynamic transducer in the first embodiment described, but which in addition comprises an additional spider which is secured to the voice-coil former along an inner rim, is characterized in that (a) as a first step a number of assemblies are manufactured, namely
  an assembly comprising a loudspeaker chassis and the magnet system,
  an assembly comprising the voice-coil former, voice coil and spider,
  an assembly comprising the auxiliary cone and centring diaphragm,
  an assembly comprising the further auxiliary cone and the sound-radiating diaphragm,
(b) as a second step, the assembly comprising the voice-coil former, voice coil and spider is secured to the assembly comprising the loudspeaker chassis and the magnet system by centring means known per se,
(c) as a third step the assembly comprising the auxiliary cone and centring diaphragm is mounted, and
(d) as a fourth step the assembly comprising the further auxiliary cone and the sound-radiating diaphragm is mounted.

The method of manufacturing an electrodynamic transducer in accordance with the invention in the second embodiment described is characterized in that (a) as a first step a number of assemblies are manufactured, namely an assembly comprising a loudspeaker chassis and the magnet system, and an assembly comprising the voice-coil former, voice coil, auxiliary cone, coupling element and centring diaphragm, (b) as a second step the assembly comprising the voice-coil former, voice coil, auxiliary cone, coupling element and centring diaphragm is secured to the assembly comprising the loudspeaker chassis and magnet system by centring means known per se, and (c) as a third step the sound-radiating diaphragm is mounted.

The method of manufacturing an electrodynamic transducer in the second embodiment described but which in addition comprises an additional spider which is secured to the voice-coil former along an inner rim, is characterized in that (a) as a first step a number of assemblies are manufactured, namely an assembly comprising a loudspeaker chassis and the magnet system, an assembly comprising the voice-coil former, voice coil and spider, and an assembly comprising the auxiliary cone, coupling element and centring diaphragm, (b) as a second step the assembly comprising the voice-coil former, voice coil and spider is secured to the assembly comprising the loudspeaker chassis and the magnet system by centring means known per se, (c) as a third step the assembly comprising the auxiliary cone, coupling element and centring diaphragm is mounted, (d) as a fourth step the sound-radiating diaphragm is mounted.

All the methods described in the foregoing allow the use of known centring techniques which are customary in the manufacture of cone loudspeakers because of the convenient construction of the transducer in accordance with the invention. This simple manufacturing method reduces the manufacturing costs and provides correctly centred flat-diaphragm transducers which produce sound with a very low distortion. Some embodiments of the invention will now be described in more detail with reference to the accompanying drawings, in which.

Figure 1:
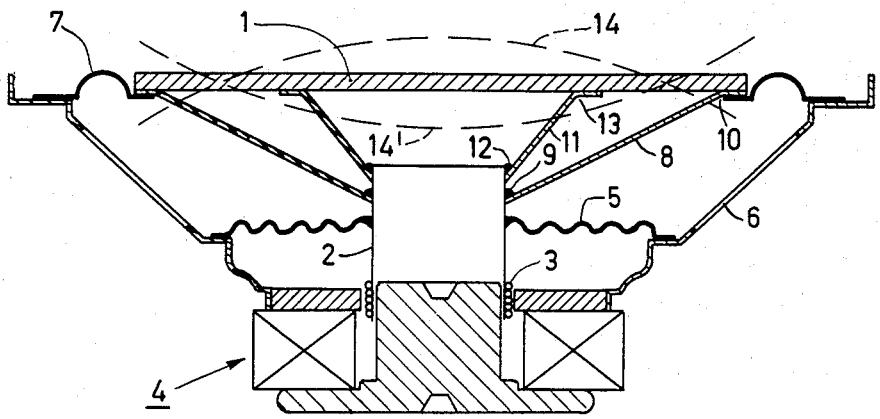
FIG. 1 shows a first embodiment.
Figure 2:
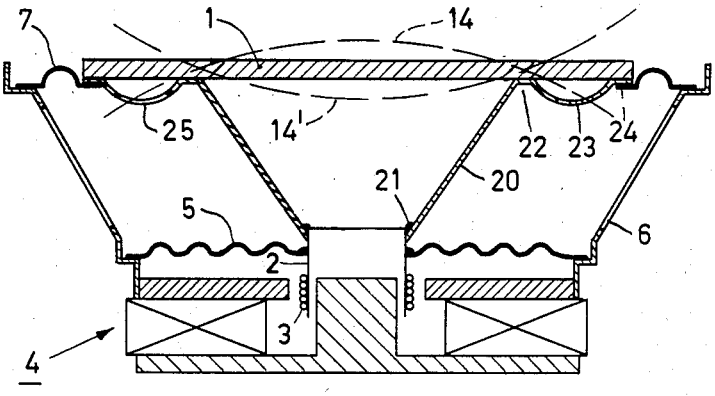
FIG. 2 shows a second embodiment of the transducer in accordance with the invention.

FIG. 1 is a sectional view of a first embodiment. The electrodynamic transducer shown comprises a sound-radiating diaphragm 1 having a flat sound-radiating side, a voice-coil former 2 and a voice coil 3 arranged on the voice-coil former. The voice-coil former with the voice coil can move in an air gap which is formed in the magnet system 4. The construction of the magnet system is conventional and requires no further explanation because the invention is not aimed at steps relating to the magnet system. Therefore, the scope of the invention is not limited to those transducers having a magnet system constructed exactly as shown in FIG. 1. The voice-coil former 2 is secured to the loudspeaker chassis 6 via a spider 5. The spider 5, however, is not essential and may in principle be dispensed with because, in fact, it suffices to center the voice-coil former by means of the auxiliary cone 8, to be described hereinafter, and the centring diaphragm 7. It is alternatively possible to achieve a satisfactory centring of the voice-coil former by means of a magnetic fluid in the air gap. The auxiliary cone 8 is secured to the voice-coil former at its inner rim 9. The outer rim 10 of the auxiliary cone 8 is connected directly to the centring diaphragm 7. Via the centring diaphragm 7 the auxiliary cone 8 is secured to the loudspeaker chassis 6. A further auxiliary cone 11 is also secured to the voice-coil former at the location of its inner rim 12. The sound-radiating diaphragm 1 is secured to the auxiliary cones 8 and 11 respectively at the outer rims 10 and 13 respectively of these cones. The line where the auxiliary cone 8 and the diaphragm 1 are secured to each other is disposed along the circumference of the diaphragm 1. In the absence of the auxiliary cone 11 the diaphragm 1 may vibrate at a natural resonant frequency as a result of the transmission of the movement of the voice-coil former via the auxiliary cone 8, for example at the lowest natural resonant frequency. The excursion pattern for the maximum negative and positive excursion at this lowest natural resonant frequency is represented by the dashed lines 14 and 14'. The natural resonances give rise to peaks in the frequency response curve of the transducer so that the frequency range of the transducer becomes very small. Moveover, the diaphragm 1 no longer behaves as a rigid flat piston, which is in fact required for flat-diaphragm transducers. By providing the further auxiliary cone 11 a number of natural resonances, including the lowest resonant frequency, are suppressed because, at the location of the connection between auxiliary cone 11 and diaphragm 1, the diaphragm can move now only in accordance with the vibration as imposed on the said diaphragm 1 by means of the auxiliary cone 11. The diaphragm 1 may be constructed using a sandwich construction, for example as known from German Offenlegungsschrift 28.50.786 or as a single layer of suitable material with a sufficiently high stiffness. In the embodiment shown in FIG. 1, in which the movement is transmitted via two auxiliary cones, it is possible to use a diaphragm having a lower stiffness than that in the embodiment comprising only one auxiliary cone, as shown in FIG. 2. The lower stiffness of such a diaphragm, in comparison with the higher stiffness of a diaphragm as shown in FIG. 2, is then compensated for by the drive via two cones. The centring diaphragm 7 shown in FIG. 1 having only one corrugation. However, this is not necessary. The centring diaphragm 7 may alternatively be constructed as shown for the spider 5, i.e. having more than one corrugation.

FIG. 2 shows a second embodiment in sectional view. Parts shown in FIGS. 1 and 2 bearing the same reference numerals are identical.

Here an auxiliary cone 20 is secured to the voice-coil former 2 along its inner rim 21. Furthermore, the auxiliary cone 20 is secured to the sound-radiating diaphragm 1 along its outer rim 22. The auxiliary cone 20 is also connected to the centring diaphragm 7 via a coupling element 23. The coupling element may be a separate component which is secured to the outer rim 22 of the auxiliary cone and to the centring diaphragm. It is also possible that the coupling element 23 and the centring diaphragm 7 are made of the same material and are integral with one another. However, it is alternatively possible to manufacture the coupling element 23 and the auxiliary cone 20 from the same material so that these parts are integral with one another. This last-mentioned case is represented by FIG. 2. The coupling element may comprise one component. However, it is also possible to form the connection between the auxiliary cone 20 and the centring diaphragm 7 by means of a plurality of coupling elements, for example by narrow strips which, viewed perpendicularly to the surface of the diaphragm 1, extend radially from the outer rim of the auxiliary cone to the centring diaphragm. Hereinafter, reference will be made to a single coupling element. The coupling element 23 is secured to the sound-radiating diaphragm 1 at least at the location of the connecting portion to the centring diaphragm, designated by the reference numeral 24. However, it is alternatively possible to construct the coupling element 23 as a flat element and to secure the diaphragm 1 to the coupling element over the entire surface area of the coupling element, for example by means of glue. However, this requires more glue than in the case where the connection to the diaphragm 1 is made only at the location of the outer rim 22 and the connecting portion 24, which is a disadvantage for reasons of weight. The weight of the moving portion of the transducer should be minimized in order to obtain a maximum efficiency of the electroacoustic conversion. For the purpose of weight reduction the auxiliary cone and/or the coupling element 23 may be formed with openings or perforations in the embodiments shown in FIGS. 1 and 2. In FIG. 2 this is indicated by 25 for the coupling element.

The auxiliary cone is secured to the sound-radiating diaphragm 1 along a line disposed within the circumference of this diaphragm. Preferably, this line is the nodal line for the first natural resonance of the sound-radiating diaphragm. Again 14 and 14' designate the maximum positive and negative excursions of the diaphragm 1 for said first (and lowest) natural resonant frequency. It is clear from the figure that the diaphragm 1 is along a nodal line (the excursion of the diaphragm 1 is zero at this location). It is possible (but not necessary) to excite the diaphragm along the entire nodal line. It is alternatively possible to transmit the movement along portions of—or via some points disposed on—the nodal line.

Figure 3:
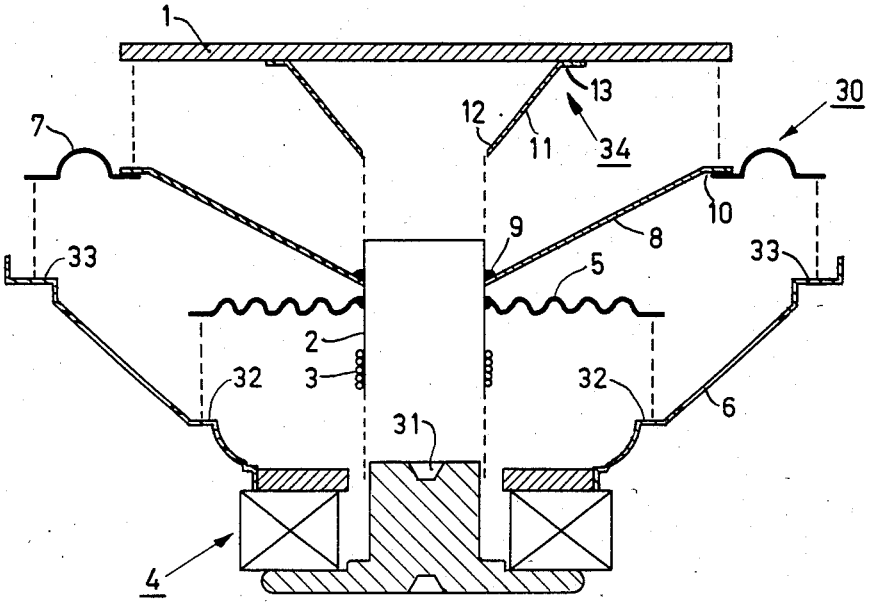
FIG. 3 illustrates a method of manufacturing the transducer shown in FIG. 1.

FIG. 3 illustrates the various steps of the method of manufacturing a transducer in accordance with the invention as described with reference to FIG. 1.

As a first step a number of assemblies are manufactured, namely

- an assembly comprising the loudspeaker chassis 6 and the magnet system 4,
- an assembly comprising the voice-coil former 2, the voice coil 3, the auxiliary cone 8, and the spider 5 (if present), and the centring diaphragm 7—this assembly is designated 30, and
- an assembly comprising the further auxiliary cone 11 and the sound-radiating diaphragm 1—this assembly is designated 34.

As a second step the assembly 30 is secured to the assembly of the loudspeaker chassis 6 and the magnet system 4 using centring means known per se (i.e. by centring relative to a notch 31 in the core of the magnet system 4 or by means of a centring sleeve around the core). For this purpose the spider 5 (if present) is secured to the contact surface 32 and the centring diaphragm 7 to the contact surface 33 of the loudspeaker chassis 6 (for example, by gluing or ultrasonic welding).

As a third step (after removal of the centring sleeve—if used during the centring process in the second step) the assembly 34 is mounted. For this purpose the inner rim of the auxiliary cone 11 is secured to the voice-coil former 2 and the outer rim of the diaphragm 1 to the outer rim of the auxiliary cone 8.

The method of manufacturing a transducer, of the type shown in FIG. 1 does not require the use of a spider 5. The voice-coil former may also be centred in the air gap of the magnet system (as already stated) solely by means of the auxiliary cone 8 and the centering diaphragm 7 or by means of a magnetic fluid (ferrofluid) in the air gap. Another method, to be described hereinafter, of manufacturing a transducer as shown in FIG. 1 does require the use of a spider 5. This other method (which is not illustrated by a separate Figure) comprises the manufacture of a number of assemblies as a first step, namely

- an assembly comprising the loudspeaker chassis and the magnet system 4,
- an assembly comprising the voice-coil former 2, the voice coil 3 and the spider 5,
- an assembly comprising the auxiliary cone 8 and the centring diaphragm 7, and
- an assembly comprising the further auxiliary cone 11 and the diaphragm 1.

As a second step the assembly comprising the voice-coil former 2, the voice coil 3 and the spider 5 is secured to the assembly comprising the loudspeaker chassis 6 and the magnet system 4 by centring means known per se. For this purpose the spider 5 is secured to the contact surface 32 (see FIG. 3) of the loudspeaker chassis 6.

As a third step the assembly comprising the auxiliary cone 8 and the centring diaphragm 7 is mounted. For this purpose the auxiliary cone 8 is secured to the voice-coil former 2 along its inner rim 9 and the centring diaphragm 7 is secured to the contact surface 33 of the loudspeaker chassis 6 along its outer circumference.

As a fourth step the assembly comprising the further auxiliary cone 11 and the diaphragm 1 is mounted in the same way as in the third step of the preceding method.

Figure 4:
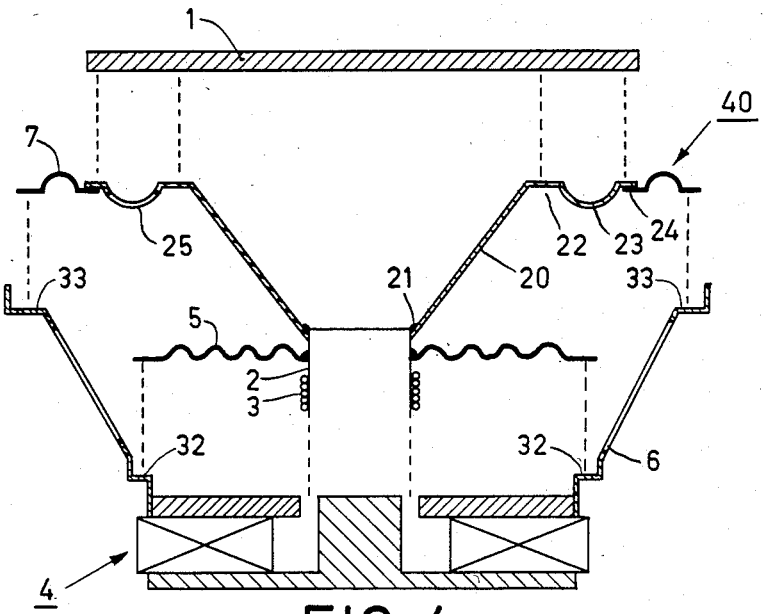
FIG. 4 illustrates a method of manufacturing the transducer shown in FIG. 2.

FIG. 4 illustrates the various steps of a method of manufacturing a transducer in accordance with the invention as described with reference to FIG. 2.

As a first step a number of assemblies is manufactured, namely

- an assembly comprising a loudspeaker chassis 6 and the magnet system 4,
- an assembly comprising the voice-coil former 2, the voice coil 3, the spider 5 (if present), the auxiliary cone 20, the coupling element 23 and the centring diaphragm 7. This assembly is designated 40.

As a second step the assembly 40 is secured to the loudspeaker chassis 6 by centring means known per se. For this purpose the spider 5 (if present) is secured to the contact surface 32 and the centring diaphragm 7 is secured to the contact surface 33 of the loudspeaker chassis 6.

As a third step the diaphragm 1 is mounted. For this purpose it is secured to the auxiliary cone 20 at the location of the outer rim 22 of the auxiliary cone and to the coupling element 23 at the location of the portion 24. As already stated, the use of a spider 5 is not necessary in this method.

Another method of manufacturing the transducer shown in FIG. 2, which will be described briefly hereinafter, does require the use of a spider 5. This further method (which is not illustrated by means of a separate Figure) comprises the manufacture of a number of assemblies in a first step, namely an assembly comprising the loudspeaker chassis 6 and the magnet system 4, an assembly comprising the voice-coil former 2, the voice coil 3 and the spider 5, and an assembly comprising the auxiliary cone 20, the coupling element 23 and the centring diaphragm 7.

As a second step the assembly comprising the voice-coil former 2, the voice coil 3 and the spider 5 is secured to the loudspeaker chassis 6 by centring means known per se.

As a third step the assembly comprising the auxiliary cone 20, the coupling element 23 and the centring diaphragm 7 is mounted and in a fourth step the diaphragm 1 is mounted. It is to be noted that the invention is not limited to the embodiments described with reference to FIGS. 1 and 2. The invention also relates to those embodiments which differ from the embodiments shown with respect to points which do not relate to the inventive idea. Nor is the invention limited to those methods of making the transducer in accordance with the invention as described in the foregoing with reference to FIGS. 3 and 4. The invention also relates to those methods which differ from methods described with respect to points which do not relate to the inventive idea. For example, the sequence in which the assemblies are manufactured in the first steps of the methods described is not limited to the sequence specified. Another sequence may be chosen. It is alternatively possible to manufacture an assembly (for example the assembly 34 in FIG. 3) at a later stage (for example between the second and the third step in the first method described), namely at the instant that this assembly is actually required for assembling to the transducer.

Finally it is to be noted that when the description and the Claims refer to a flat sound-radiating side (surface) this is to be understood to mean that the invention also applies to transducers whose sound-radiating side (surface) of the diaphragm is provided with an ornamental pattern or other surface structures but whose sound-radiating side (surface) is substantially flat.

What is claimed is:

1. An electrodynamic transducer comprising:

a sound-radiating diaphragm having a substantially flat sound-radiating side, a magnet system having an air gap, a voice coil former with a voice coil mounted thereon and located in said air gap so as to cooperate with the magnet system, a first auxiliary cone for transmitting the movement of the voice coil former to the sound-radiating diaphragm, the first auxiliary cone having an inner rim secured to the voice-coil former and an outer rim secured to the sound-radiating diaphragm along the periphery of the sound-radiating diaphragm, at least one centering diaphragm connected to the outer rim of the auxiliary cone, and a further auxiliary cone having an inner rim secured to the voice-coil former and an outer rim secured to the sound-radiating diaphragm with the further auxiliary cone disposed inside of the first auxiliary cone.

2. An electrodynamic transducer as claimed in claim 1 wherein the outer periphery of the centering diaphragm is secured to a chassis of the transducer.

3. An electrodynamic transducer as claimed in claim 1 wherein the further auxiliary cone is secured to the sound radiating diaphragm thereby to suppress at least one natural resonant frequency vibration of the sound radiating diaphragm.

4. An electrodynamic transducer comprising:

a sound-radiating diaphragm having a substantially flat sound-radiating side, a magnet system having an air gap, a voice-coil former with a voice coil mounted thereon and located in said air gap so as to cooperate with the magnet system, an auxiliary cone for transmitting the movement of the voice-coil former to the sound-radiating diaphragm, the auxiliary cone having an inner rim secured to the voice-coil former and an outer rim secured to the sound-radiating diaphragm, and at least one centering diaphragm connected to the outer rim of the auxiliary cone via a coupling element, the outer rim of the auxiliary cone and the sound-radiating diaphragm being secured to each other along a line situated within the circumference of the sound-radiating diaphragm and the coupling element being secured to the sound-radiating diaphragm at least in the area where it is secured to the centering diaphragm.

5. An electrodynamic transducer as claimed in claim 4, wherein the auxiliary cone and the coupling element are made from the same material and form an integral unit.

6. An electrodynamic transducer as claimed in claim 4 wherein the coupling element and the centering diaphragm are made from the same material and form an integral unit.

7. An electrodynamic transducer as claimed in claim 4 wherein said line is the nodal line for the first natural resonant frequency of the sound-radiating diaphragm.

8. An electrodynamic transducer as claimed in claim 4 wherein the auxiliary cone is formed with perforations.

9. An electrodynamic transducer as claimed in claim 4 wherein the coupling element includes perforations.

10. An electrodynamic transducer as claimed in claim 4 wherein said coupling element is secured to the sound radiating diaphragm near the periphery of said diaphragm.

11. An electrodynamic transducer as claimed in claim 10 wherein the auxiliary cone and coupling element form an integral unit made of the same material.

12. A method of making an electrodynamic transducer comprising:

as a first step forming a number of assemblies, namely an assembly comprising a loudspeaker chassis and a magnet system, an assembly comprising a voice-coil former, voice coil, auxiliary cone and centering diaphragm, and an assembly comprising a further auxiliary cone and a sound-radiating diaphragm, (b) as a second step securing the assembly comprising the voice-coil former, voice coil, auxiliary cone and centering diaphragm to the asembly comprising the loudspeaker chassis and the magnet system by a known centering means, and (c) as a third step mounting the assembly comprising the further auxiliary cone and sound-radiating diaphragm.

13. A method of making an electrodynamic transducer comprising:

(a) as a first step forming a number of assemblies namely an assembly comprising a loudspeaker chassis and a magnet system, an assembly comprising a voice-coil former, voice coil and spider, an assembly comprising an auxiliary cone and centring diaphragm, an assembly comprising a further auxiliary cone and a sound-radiating diaphragm, (b) as a second step securing the assembly comprising the voice-coil former, voice coil and spider to the assembly comprising the loudspeaker chassis and the magnet system, (c) as a third step mounting the assembly comprising the auxiliary cone and centering diaphragm, and (d) as a fourth step mounting the assembly comprising the further auxiliary cone and the sound-radiating diaphragm.

14. A method of making an electrodynamic transducer comprising:

(a) as a first step forming a number of assemblies, namely an assembly comprising a loudspeaker chassis and a magnet system, and an assembly comprising a voice-coil former, voice coil, auxiliary cone, coupling element and centering diaphragm, (b) as a second step securing the assembly comprising the voice-coil former, voice coil, auxiliary cone, coupling element and centering diaphragm to the assembly comprising the loudspeaker chassis and magnet system by a known centering means, and (c) as a third step mounting the sound-radiating diaphragm.

15. A method of making an electrodynamic transducer (a) as a first step forming a number of assemblies, namely an assembly comprising a loudspeaker chassis and a magnet system, an assembly comprising a voice-coil former, voice coil and spider, and an assembly comprising an auxiliary cone, coupling element and centering diaphragm, (b) as a second step securing the assembly comprising the voice-coil former, voice coil and-spider to the assembly comprising the loudspeaker chassis and the magnet system, (c) as a third step mounting the assembly comprising the auxiliary cone, coupling element and centering diaphragm, and (d) as a fourth step mounting the sound-radiating diaphragm.

16. A method of making an electrodynamic transducer comprising the following steps: forming first, second and third assemblies, not necessarily in the order named, the first assembly comprising a loudspeaker chassis with a magnet system having an air gap therein, the second assembly comprising a voice-coil former with a voice coil thereon, an auxiliary cone having an inner rim secured to the voice-coil former and a centering diaphragm secured to an outer rim of the auxiliary cone, and the third assembly comprising a further auxiliary cone having an outer rim secured to a surface of a flat sound radiating diaphragm, securing the second assembly to the first assembly so that the voice coil former is within the magnet system air gap and the centering diaphragm is secured to the loudspeaker chassis, and mounting the third assembly so that the inner rim of the further auxiliary cone is secured to the voice-coil former so as to locate the further auxiliary cone within the auxiliary cone and so that the outer rim of the auxiliary cone is secured to said surface of the flat diaphragm near the periphery of said diaphragm.

17. A method of making an electrodynamic transducer comprising the following steps: forming first and second assemblies not necessarily in the order named, the first assembly comprising a loudspeaker chassis with a magnet system having an air gap therein, the second assembly comprising a voice-coil former with a voice coil thereon, an auxiliary cone having an inner rim secured to the voice-coil former and a centering diaphragm secured to an outer rim of the auxiliary cone via a coupling element, securing the second assembly to the first assembly so that the voice-coil former is within the magnet system air gap and the centering diaphragm is secured to the loudspeaker chassis, and securing a flat sound radiating diaphragm to the outer rim of the auxiliary cone.

* * * * *

UNITED STATES PATENT AND TRADEMARK OFFICE

CERTIFICATE OF CORRECTION

PATENT NO. : 4,567,327

DATED : January 28, 1986

INVENTOR(S) : URBANUS P.M. GOOSSENS
GUSTAAF E.M. FIERENS

It is certified that error appears in the above-identified patent and that said Letters Patent is hereby corrected as shown below:

COL. 10, Line 45, before "as" insert --(a)--.

COL. 10, Line 63, after "assemblies" insert --, (comma)--

COL. 11, Line 33, after "ducer" insert --comprising:--.

Signed and Sealed this

Twenty-eighth Day of October, 1986

[SEAL]

*Attest:*

DONALD J. QUIGG

*Attesting Officer* *Commissioner of Patents and Trademarks*